US009505251B2

(12) United States Patent
Sasaki et al.

(10) Patent No.: US 9,505,251 B2
(45) Date of Patent: Nov. 29, 2016

(54) RECORDING APPARATUS AND METHOD FOR ESTIMATING CAUSE OF ABNORMALITY OF RECORDING APPARATUS

(71) Applicant: SEIKO EPSON CORPORATION, Tokyo (JP)

(72) Inventors: Tsuneyuki Sasaki, Matsumoto (JP); Osamu Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/668,502

(22) Filed: Mar. 25, 2015

(65) Prior Publication Data

US 2015/0273921 A1 Oct. 1, 2015

(30) Foreign Application Priority Data

Mar. 27, 2014 (JP) ..... 2014-065424

(51) Int. Cl.

| | |
|---|---|
| ***B41J 29/393*** | (2006.01) |
| ***B41J 29/38*** | (2006.01) |
| ***H04R 1/08*** | (2006.01) |
| ***B41J 29/46*** | (2006.01) |
| ***H04R 29/00*** | (2006.01) |
| *B41J 11/70* | (2006.01) |

(52) U.S. Cl.

CPC ..... *B41J 29/393* (2013.01); *B41J 29/38* (2013.01); *B41J 29/46* (2013.01); *H04R 1/08* (2013.01); *H04R 29/005* (2013.01); *B41J 11/70* (2013.01)

(58) Field of Classification Search

CPC ..... B41J 29/393; B41J 29/38; H04R 1/08; H04R 29/005

USPC ..... 347/14, 19; 358/1.15, 296

See application file for complete search history.

(56) References Cited

U.S. PATENT DOCUMENTS

| | | | | |
|---|---|---|---|---|
| 2006/0182451 | A1 | 8/2006 | Shoji et al. | |
| 2007/0070456 | A1 | 3/2007 | Nishimura | |
| 2009/0190939 | A1* | 7/2009 | Satoh | G03G 21/0011 399/34 |

FOREIGN PATENT DOCUMENTS

| | | |
|---|---|---|
| JP | 04-355772 | 12/1992 |
| JP | 2006-201316 | 8/2006 |
| JP | 2006-208074 | 8/2006 |
| JP | 2007-079263 | 3/2007 |
| JP | 2008-304872 | 12/2008 |

* cited by examiner

*Primary Examiner* — Jannelle M Lebron

(74) *Attorney, Agent, or Firm* — Workman Nydegger

(57) ABSTRACT

A recording apparatus includes a sound pickup unit that is arranged on a plurality of spots, and an output unit that is capable of outputting comparative information between a sound which is picked up by the sound pickup unit, and each sound pickup unit at a time of picking up the sound. By the recording apparatus of such a configuration, a cause of an abnormality can be estimated, regarding the abnormality which is generated in the recording apparatus.

7 Claims, 5 Drawing Sheets

RECORDING APPARATUS AND METHOD FOR ESTIMATING CAUSE OF ABNORMALITY OF RECORDING APPARATUS

BACKGROUND

1. Technical Field

The present invention relates to a recording apparatus and a method for estimating a cause of an abnormality of a recording apparatus.

2. Related Art

In the past, a recording apparatus forming an image in a recording medium, is used. Meanwhile, the recording apparatus that detects an abnormality of the recording apparatus by a sound which is generated within the recording apparatus, is disclosed.

For example, in JP-A-2008-304872, JP-A-2006-201316, or JP-A-2007-79263, the recording apparatus that detects the abnormality of the recording apparatus by the sound which is generated within the recording apparatus, is disclosed.

However, in the recording apparatus of a related art such as the recording apparatus which is disclosed in JP-A-2008-304872, JP-A-2006-201316, or JP-A-2007-79263, a detection unit that detects the abnormality of the recording apparatus by the sound which is generated within the recording apparatus, is included, but it is not possible to estimate up to a cause of the abnormality.

Hence, although the abnormality of the recording apparatus can be detected, the cause of the abnormality is not found out, and it may be difficult to remove the cause of the abnormality.

SUMMARY

An advantage of some aspects of the invention is to estimate a cause of an abnormality, regarding the abnormality which is generated in a recording apparatus.

According to a first aspect of the invention, there is provided a recording apparatus including a sound pickup unit that is arranged on a plurality of spots, and an output unit that is capable of outputting comparative information between a sound which is picked up by the sound pickup unit, and each sound pickup unit at a time of picking up the sound.

In the recording apparatus, an estimating unit that estimates a cause of an abnormality from a sound pickup time difference between the sounds which are picked up by each of the sound pickup units, may be further included, and the comparative information may be the cause of the abnormality.

In the recording apparatus, the sound pickup unit may be arranged on at least one spot of a movement unit that includes a recording head and moves reciprocatably in a direction intersecting with a transport direction of a recording medium, a drive unit of the movement unit, a cutting unit of the recording medium, and an adjustment unit that is capable of adjusting a gap between the recording head and the recording medium.

In the recording apparatus, a first sound pickup unit, a second sound pickup unit, and a third sound pickup unit may be included as the sound pickup unit, and the third sound pickup unit may be arranged on a spot to deviate from a straight line that is configured by a spot on which the first sound pickup unit is arranged and a spot on which the second sound pickup unit is arranged.

In the recording apparatus, a fourth sound pickup unit may be further included as the sound pickup unit, and the fourth sound pickup unit may be arranged on a spot to deviate from a plane that is configured by a spot on which the first sound pickup unit is arranged, a spot on which the second sound pickup unit is arranged, and a spot on which the third sound pickup unit is arranged.

In the recording apparatus, the sound pickup unit may be a unidirectional sound pickup unit.

In the recording apparatus, the output unit may output the comparative information in a case of an emergency stop of the recording apparatus.

According to a second aspect of the invention, there is provided a method for estimating a cause of an abnormality of a recording apparatus that includes a sound pickup unit which is arranged on a plurality of spots, including estimating a cause of an abnormality from a sound pickup time difference between sounds which are picked up by each of the sound pickup units.

According to the aspects of the invention, it is possible to estimate the cause of the abnormality, regarding the abnormality which is generated in the recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention, will be described in detail, with reference to accompanying drawings.

First, an outline of a recording apparatus 1 of the embodiment, will be described.

Figure 1:
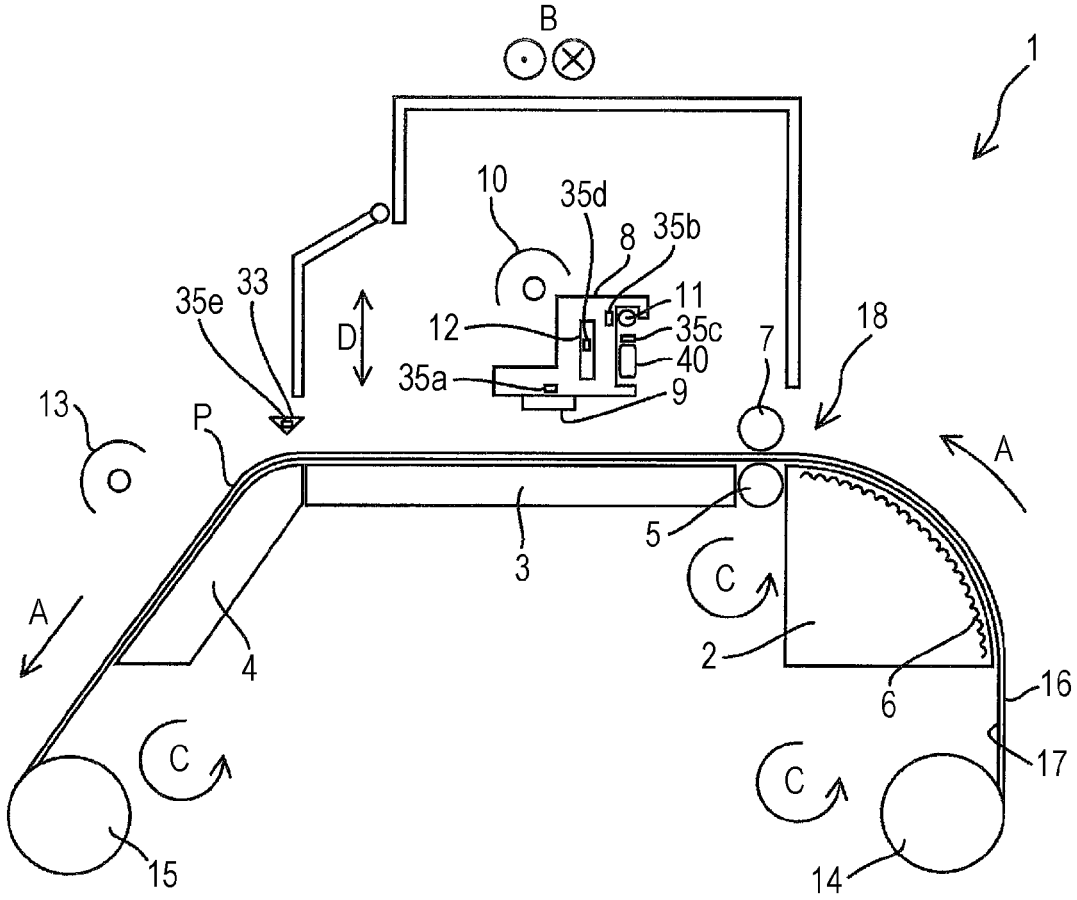
FIG. 1 is a schematic side view illustrating a recording apparatus according to an embodiment of the invention.
Figure 2:
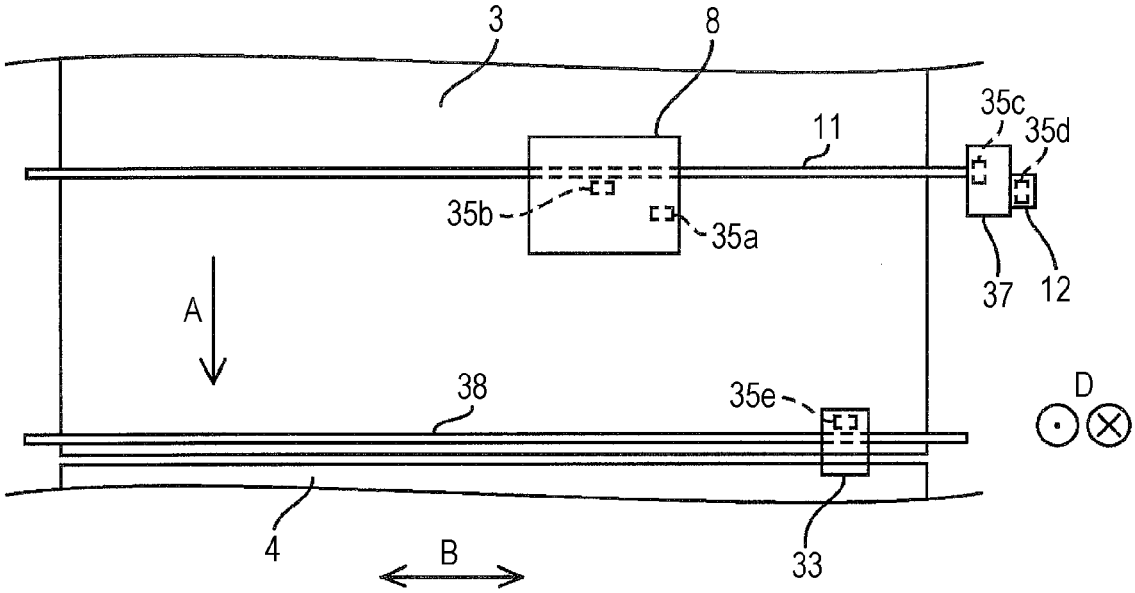
FIG. 2 is a schematic plan view illustrating the recording apparatus according to the embodiment of the invention.

FIG. 1 is a schematic side view illustrating the recording apparatus 1 according to the embodiment of the invention, and FIG. 2 is a schematic plan view of the recording apparatus 1.

As illustrated in FIG. 1, the recording apparatus 1 of the embodiment, transports a recording medium P in a transport direction A, from a set unit 14 of the recording medium P up to a winding unit 15 of the recording medium P, through a platen 2, a platen 3, and a platen 4 which are supporting units of the recording medium P. That is, a transport path of the recording medium P in the recording apparatus 1, is from the set unit 14 up to the winding unit 15, and the platen 2, the platen 3 and the platen 4 are the supporting units of the recording medium P which are arranged in the transport path. Furthermore, the set unit 14 is rotated in a rotation direction C, and sends out the recording medium P, and the winding unit 15 is rotated in the rotation direction C, and winds the recording medium P.

The recording apparatus 1 of the embodiment, has a configuration which is capable of performing recording onto a roll-shaped recording medium P, but is not limited to such the configuration, and may have the configuration which is capable of performing the recording onto a cut sheet-shaped recording medium P. In a case of the configuration which is capable of performing the recording onto the cut sheet-shaped recording medium P, as a set unit 14 of the recording medium P, for example, a unit which is referred to as a so-called paper feeding (feed) tray or a so-called paper feeding (feed) cassette, may be used. Moreover, as a recovery unit of the recording medium P, and as a recovery unit of other than the winding unit 15, for example, a reception unit for discharge which is referred to as a so-called paper discharging (discharge) tray or a so-called paper discharging (discharge) cassette, may be used.

Since the roll type recording medium P which is wound so that a recording face 16 becomes an outside, is used in the embodiment, a rotation axis of the set unit 14 is rotated in the rotation direction C, when the recording medium P is sent out from the set unit 14. On the other hand, in the case of using the roll type recording medium P which is wound so that the recording face 16 becomes an inside, the rotation axis of the set unit 14 is counter-rotated to the rotation direction C, and the recording medium P may be sent out.

Similarly, since the winding unit 15 of the embodiment winds the recording medium P so that the recording face 16 of the recording medium P becomes the outside, the rotation axis of the winding unit 15 is rotated in the rotation direction C. On the other hand, in the case of winding the recording medium P so that the recording face 16 becomes the inside, the rotation axis of the winding unit 15 is counter-rotated to the rotation direction C, and the recording medium P may be wound.

In the embodiment, a heater 6 is arranged in the platen 2 of the recording apparatus 1. The heater 6 is arranged in order to heat (so-called preheating) the recording medium P before the recording is executed by a recording head 9 as a recording unit.

The recording apparatus 1 of the embodiment has the configuration of preheating the recording medium P from a face 17 side which is an opposite side to the recording face 16 of the recording medium P, using the heater 6. However, for example, the recording apparatus 1 may have the configuration of preheating the recording medium P from the recording face 16 side, using a heater which is capable of heating the recording medium P by irradiating the recording medium P with infrared rays from the recording face 16 side of the recording medium P.

Moreover, in the recording apparatus 1 of the embodiment, a drive roller 5 that has the rotation axis of a direction B intersecting with the transport direction A, and gives forwarding power to the face 17 of the recording medium P, is arranged between the platen 2 and the platen 3. Therefore, a driven roller 7 that has the rotation axis of the direction B, is arranged in a position (upper portion) which is opposed to the drive roller 5. By the drive roller 5 and the driven roller 7 configuring a pair of rollers, it is possible to transport the recording medium P by pinching the recording medium P therebetween. That is, a transport unit 18 is configured by the drive roller 5 and the driven roller 7. Here, the driven roller means a roller which rotates along with the transport of the recording medium P.

When the recording medium P is transported in the transport direction A, the drive roller 5 is rotated in the rotation direction C, and the driven roller 7 is rotated in the counter direction to the rotation direction C. Therefore, when the recording medium P is transported in the counter direction to the transport direction A, the drive roller 5 is rotated in the counter direction to the rotation direction C, and the driven roller 7 is rotated in the rotation direction C.

The recording apparatus 1 of the embodiment, includes the recording head 9 as a recording unit, on a side which is opposed to the platen 3. The recording apparatus 1 forms a desired image by discharging an ink onto the recording medium P from an ink discharge face of the recording head 9 while reciprocating the recording head 9 in the direction B intersecting with the transport direction A through a carriage 8 as a movement unit.

Moreover, the recording apparatus 1 of the embodiment, includes a guide shaft 11 which is arranged to be extended in the direction B intersecting with the transport direction A of the recording medium P. Therefore, the carriage 8 is configured to move reciprocatably in the direction B by sliding the guide shaft 11. In the carriage 8, a microphone 35*a* as a sound pickup unit, is arranged in the position which is opposed to the recording medium P, and a microphone 35*b* is arranged in the position which is opposed to the guide shaft 11.

Here, the microphone 35*a* is a microphone that is capable of picking up a sound such as the sound which is generated when the recording medium P comes into contact with the recording head 9. The microphone 35*b* is a microphone that is capable of picking up the sound such as the sound which is generated when the carriage 8 reciprocates by sliding the guide shaft 11.

Figure 3:
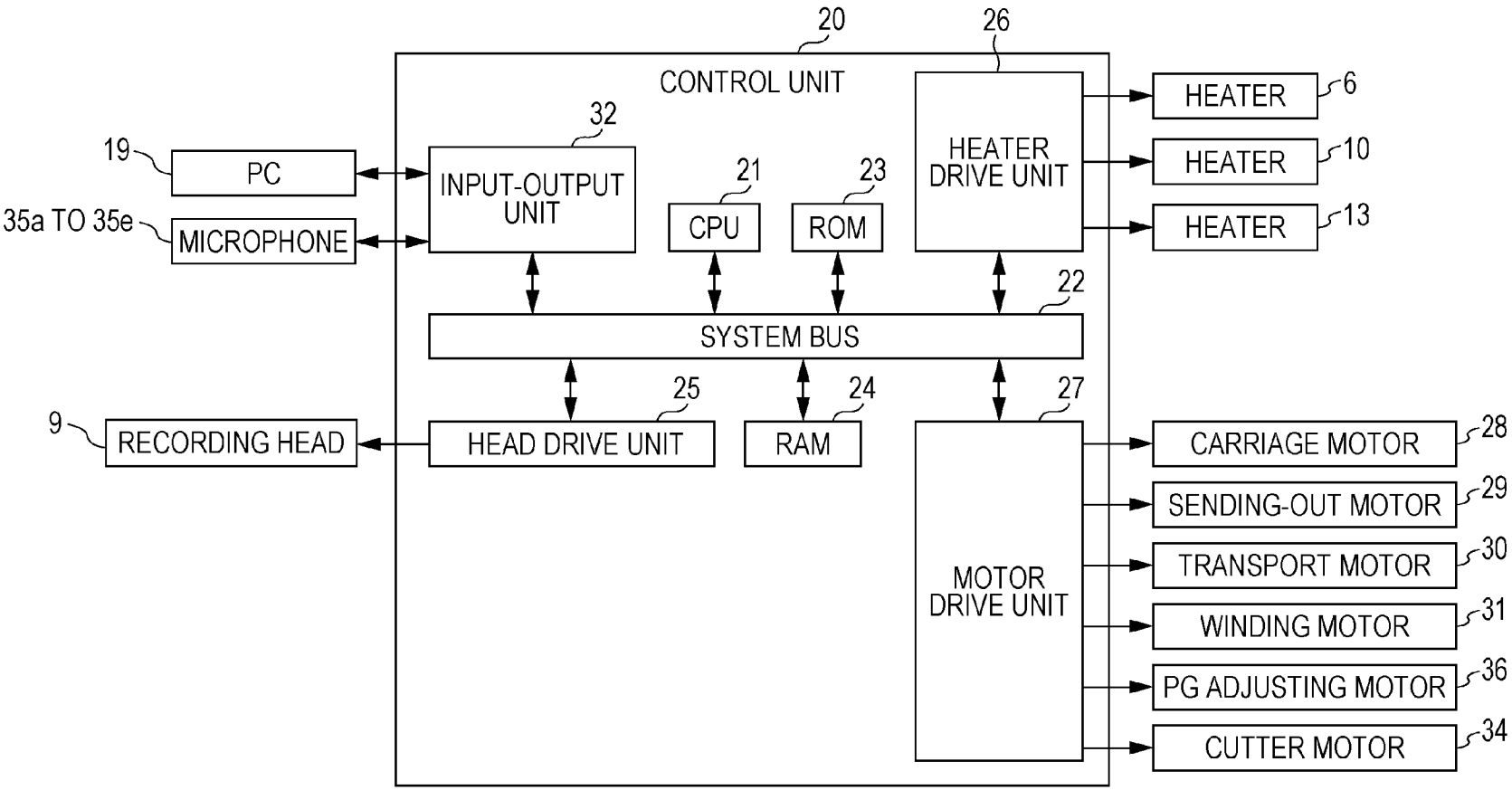
FIG. 3 is a block diagram of the recording apparatus according to the embodiment of the invention.

As illustrated in FIG. 2, the carriage 8 of the embodiment, reciprocates in the direction B, due to drive power of a drive unit 37 of the carriage 8 having a belt 40 and a carriage motor 28 (see FIG. 3). In the drive unit 37 of the carriage 8, a microphone 35*c* is arranged.

Here, the microphone 35*c* is a microphone that is capable of picking up the sound such as a drive sound of a gear which is arranged in the drive unit 37 of the carriage 8 and is not illustrated in the drawings, or the drive sound of the carriage motor 28.

In the recording apparatus 1 of the embodiment, the carriage 8 is capable of moving in a direction D which is a direction coming close to the platen 3, and is a direction separating to the platen 3, by an adjustment unit 12. In other words, the adjustment unit 12 which is capable of adjusting a gap (so-called PG) between the recording head 9 and the recording medium P, is included. In adjustment unit 12, a microphone 35*d* is arranged.

Here, the microphone 35*d* is a microphone that is capable of picking up the sound such as the drive sound of a PG adjusting motor 36 (see FIG. 3) in order to move the carriage 8 in the direction D.

Moreover, in an upper portion of the recording head 9 that is a position opposed to the platen 3, a heater 10 is arranged as a heating unit which is capable of irradiating toward a recording region with an electromagnetic wave in accordance with the recording head 9.

The heater 10 of the embodiment is arranged in the position which is opposed to the platen 3, and is an infrared heater which is capable of heating a surface of the recording face 16 side of the recording medium P.

Additionally, in the recording apparatus 1 of the embodiment, a cutter 33 is arranged as a cutting unit which is capable of cutting the recording medium P, on a downstream side in the transport direction A of the recording head 9. As illustrated in FIG. 2, the cutter 33 can cut the recording medium P along the direction B, by moving in the direction B along a guide unit 38. In the cutter 33, a microphone 35*e* is arranged.

Here, the microphone 35*e* is a microphone which is capable of picking up the sound such as a cutting sound of the recording medium P or a sliding sound with respect to the guide unit 38.

Furthermore, in the embodiment, all of the microphones 35*a*, 35*b*, 35*c*, 35*d* and 35*e* (35*a* to 35*e*) are unidirectional microphones. In this manner, since the unidirectional sound pickup unit is unlikely to be affected by a noise, it is preferable that the unidirectional sound pickup unit is used as a sound pickup unit, but it is not limited to the unidirectional sound pickup unit.

In a placement illustrated in FIG. 2, the microphones 35*a* to 35*e* are arranged. Among these, the microphones 35*a*, 35*b* and 35*e* are arranged in a configuration member which is capable of moving within the recording apparatus 1. However, it is not limited to such the configuration, and may be configured to arrange the microphone that is capable of picking up the sound which is generated when the recording medium P comes into contact with the recording head 9, the microphone that is capable of picking up the sound which is generated when the carriage 8 reciprocates by sliding the guide shaft 11, the microphone that is capable of picking up the sound such as the cutting sound of the recording medium P or the sliding sound with respect to the guide unit 38, by fixing the microphones on the inside of the recording apparatus 1.

Moreover, in the position which is opposed to the platen 4 of the downstream side in the transport direction A compared with platen 3, a heater 13 which is capable of performing the electromagnetic wave irradiation, is included. The heater 13 is an infrared heater which is capable of heating the surface of the recording medium P, in order to dry the microphone used in the recording apparatus 1 of the embodiment, but it is not limited to such a drying apparatus. For example, as a drying apparatus, a blowing apparatus such as a fan may be used, in addition to the heating apparatus such as the infrared heater.

Next, an electrical configuration of the recording apparatus 1 according to the embodiment, will be described.

FIG. 3 is a block diagram of the recording apparatus 1 according to the embodiment.

In a control unit 20, a CPU 21 administering an overall control of the recording apparatus 1, is arranged. The CPU 21 is connected to a ROM 23 which stores various types of control programs executed by the CPU 21, and a RAM 24 which is capable of temporarily storing data, through a system bus 22.

Moreover, the CPU 21 is connected to a head drive unit 25 for driving the recording head 9, through the system bus 22.

The CPU 21 is connected to a heater drive unit 26 for driving the heaters 6, 10 and 13, through the system bus 22.

Additionally, the CPU 21 is connected to a motor drive unit 27 for driving each of the carriage motor 28 for moving the carriage 8 in the direction B, a sending-out motor 29 which is a drive source of the set unit 14, a transport motor 30 which is a drive source of the drive roller 5, a winding motor 31 which is a drive source of the winding unit 15, the PG adjusting motor 36 for moving the carriage 8 in the direction D, and a cutter motor 34 for driving the cutter 33 (moving the cutter 33 in the direction B), through the system bus 22.

Furthermore, the CPU 21 is connected to an input-output unit 32 that is connected to the microphones 35*a* to 35*e* and a PC 19 inputting the recording data to the recording apparatus 1, through the system bus 22.

By such the configuration, the control unit 20 is capable of outputting comparative information between the sounds that are picked up by the microphones 35*a* to 35*e* which are arranged on a plurality of spots, and each microphone at the time of picking up the sound.

Hence, it is possible to notify the comparative information to a user, and it is possible to estimate a cause of an abnormality, regarding the abnormality which is generated in the recording apparatus 1.

Here, a term of "comparative information between the sound which is picked up by the sound pickup unit and each sound pickup unit at the time of picking up the sound" means the information including the processed data on the basis of the information, in addition to the information of the sound pickup unit itself which picks up the sound, and the time itself at the time of picking up the sound. As an example of the processed date, the data which is obtained by grouping a time chart at the time of picking up the sound, the data which is obtained by estimating the cause of the abnormality and is used for displaying the estimation, or the like may be exemplified.

Moreover, the recording apparatus 1 of the embodiment outputs the comparative information to the PC 19, but may be configured to be capable of outputting the comparative information even though the comparative information is not output.

Furthermore, the embodiment has the configuration of outputting the cause of the abnormality that is estimated from a sound pickup time difference between the sounds which are picked up by each of the microphones 35*a* to 35*e*, to the PC 19, as the comparative information.

In the recording apparatus 1 of the embodiment, the control unit 20 is capable of estimating the cause of the abnormality from the sound pickup time difference between the sounds that are picked up by each of the microphones 35*a* to 35*e* which are arranged on the plurality of spots, as an estimating unit.

In detail, the recording apparatus 1 of the embodiment, stores a generation cause of the abnormality corresponding to the sound pickup time difference between the sounds such as a sound pickup order and sound pickup timing in the microphones 35*a* to 35*e* which are arranged on the plurality of spots, in the ROM 23. The recording apparatus 1 of the embodiment has the configuration that is capable of estimating the generation cause of the abnormality by corresponding sound pickup results of the microphones 35*a* to 35*e* and the generation causes of the abnormality which are stored in the ROM 23. Hence, it is possible to remove the cause of the abnormality when the abnormality is generated.

Specifically, at which microphone among the microphones 35*a* to 35*e* the sound is detected ahead, and thereafter, at which timing and at which microphone the sound is detected, and thereby, the control unit 20 estimates the cause of the abnormality.

In this manner, the cause of the abnormality is estimated, and is notified to the user by being output to the PC 19, and thereby, the user can remove the cause by oneself when the abnormality is generated. Accordingly, it is possible to suppress a waste of working time caused by the disuse of the recording apparatus 1, such as the time for calling a person in charge of maintenance of the recording apparatus 1, or the time which is needed until the person in charge of maintenance comes and removes the cause of the abnormality.

Among the microphones 35*a* to 35*e*, the microphone at which the sound is detected, the microphone at which the sound is detected ahead, the microphone at which the sound is detected later, and the cause of the abnormality are associated therewith, on the basis of a table which is stored in the ROM 23 and is illustrated by Table described below.

Therefore, the control unit 20 estimates the cause of the abnormality, on the basis of the table which is illustrated by Table.

TABLE

| Microphone at which abnormal sound is detected | Microphone at which abnormal sound is detected ahead | Microphone at which abnormal sound is detected later | Cause of abnormality |
|---|---|---|---|
| Microphones 35a and 35b | Microphone 35a | Microphone 35b | Cause A of abnormality |
| | Microphone 35b | Microphone 35a | Cause B of abnormality |
| Microphones 35a and 35c | Microphone 35a | Microphone 35c | Cause C of abnormality |
| | Microphone 35c | Microphone 35a | Cause D of abnormality |
| Microphones 35a and 35d | Microphone 35a | Microphone 35d | Cause E of abnormality |
| | Microphone 35d | Microphone 35a | Cause F of abnormality |
| Microphones 35a and 35e | Microphone 35a | Microphone 35e | Cause G of abnormality |
| | Microphone 35e | Microphone 35a | Cause H of abnormality |
| Microphones 35b and 35c | Microphone 35b | Microphone 35c | Cause I of abnormality |
| | Microphone 35c | Microphone 35b | Cause J of abnormality |
| Microphones 35b and 35d | Microphone 35b | Microphone 35d | Cause K of abnormality |
| | Microphone 35d | Microphone 35b | Cause L of abnormality |
| Microphones 35b and 35e | Microphone 35b | Microphone 35e | Cause M of abnormality |
| | Microphone 35e | Microphone 35b | Cause N of abnormality |
| Microphones 35c and 35d | Microphone 35c | Microphone 35d | Cause O of abnormality |
| | Microphone 35d | Microphone 35c | Cause P of abnormality |
| Microphones 35c and 35e | Microphone 35c | Microphone 35e | Cause Q of abnormality |
| | Microphone 35e | Microphone 35c | Cause R of abnormality |
| Microphones 35d and 35e | Microphone 35d | Microphone 35e | Cause S of abnormality |
| | Microphone 35e | Microphone 35d | Cause T of abnormality |

Here, by the control unit 20, an example of a method for estimating the cause of the abnormality from the sound pickup time difference between the sounds which are picked up by each of the microphones 35*a* to 35*e*, will be described using a flowchart of FIG. 4.

The example is an example of estimating the cause of the abnormality when both of a jam which is generated by the carriage 8 coming into contact with the recording medium P, and a cutting failure of the recording medium P by the cutter 33, are generated. That is, the example is an example that "microphone at which the sound is detected" corresponds to "microphones 35*a* to 35*e*" in Table.

Figure 4:
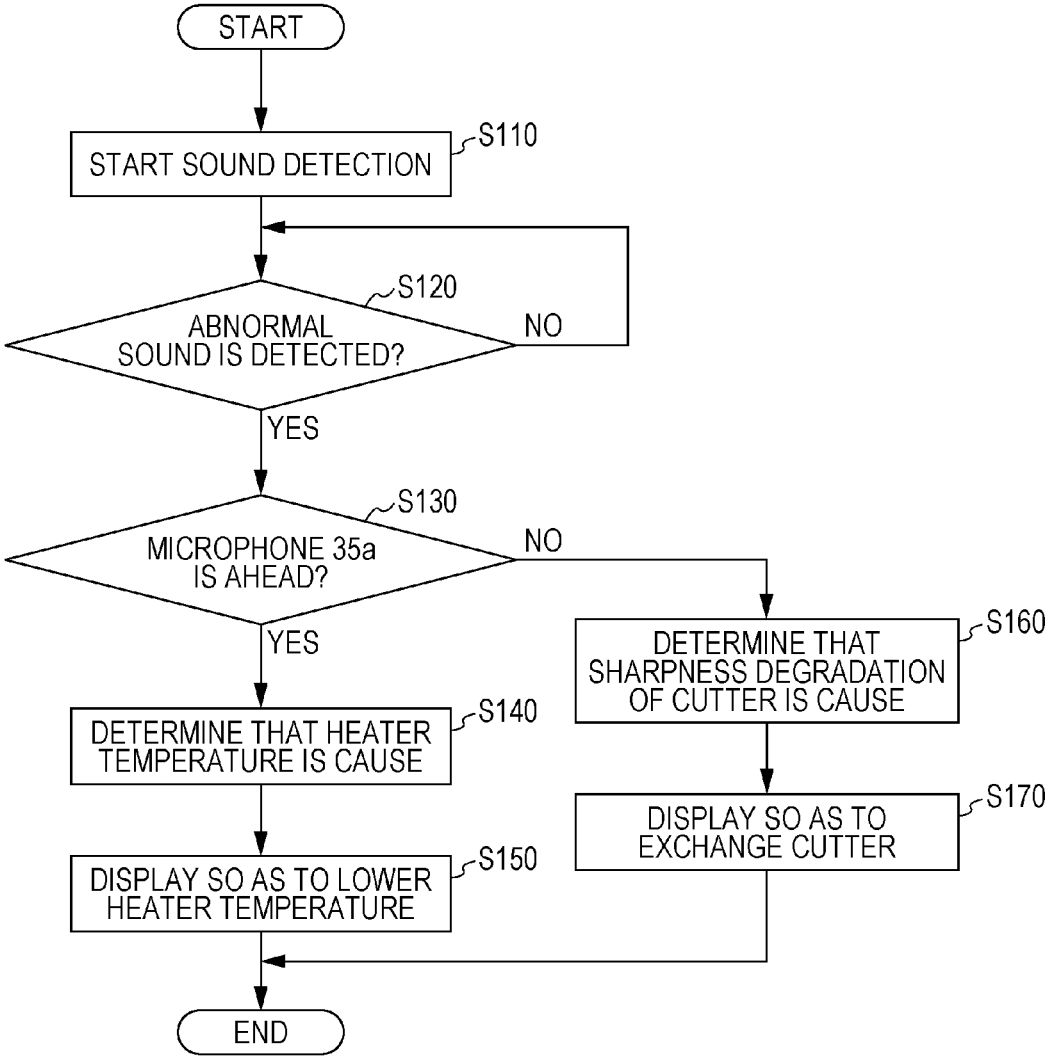
FIG. 4 is a flowchart illustrating a method for estimating a cause of an abnormality according to the embodiment of the invention.

FIG. 4 is a flowchart in the case of estimating something or other as the cause of the abnormality, depending on at which of the microphone 35*a* and the microphone 35*e* the sound is detected ahead among the microphones 35*a* to 35*e*.

In a method for estimating a cause of an abnormality according to the embodiment, in step S110, detection of the sound is started. If the picked up sound is an abnormal sound in step S120, the control unit 20 determines whether the abnormal sound is detected ahead at any of the microphone 35*a* and the microphone 35*e* in step S130.

When the control unit 20 determines that the abnormal sound is detected ahead at the microphone 35*a*, the control unit 20 proceeds to step S140, and when the control unit 20 determines that the abnormal sound is detected ahead at the microphone 35*e*, the control unit 20 proceeds to step S160.

Here, when both of the jam and the cutting failure are generated, a heating temperature of at least one of the heater 6 and the heater 10 is too high, and thereby, the recording medium P is cockled, and for that reason, both of the jam and the cutting failure may be generated. A temperature difference between the recording face 16 and the face 17 of the recording medium P becomes large, and thereby, a difference between expansion rates of both faces becomes large, and it is the reason why the cockling is generated. If the cockling is generated, the carriage 8 is likely to come into contact with the recording medium P, and the jam is likely to be generated. If the jam is generated, the recording medium P is deformed, and the cutting failure is likely to be lead.

Moreover, when both of the jam and the cutting failure are generated, due to abrasion of the cutter 33, and an attached material to the cutter 33 such as dust, paper dust or a glue in the case of using the released paper as a recording medium P, sharpness of the cutter 33 is deteriorated, and for that reason, both of the jam and the cutting failure may be generated. If the cutting failure is generated, the recording medium P is deformed, and the jam is likely to be lead.

When the sound is detected ahead at the microphone 35*a*, the jam is generated ahead, and the cutting failure is generated later. Hence, in step S140, the cause of the abnormality is determined that the heater temperature is too high. Furthermore, the determination corresponds to the case of determining that the cause of the abnormality is a cause G of the abnormality in Table. Therefore, the control unit 20 proceeds to step S150, and outputs the information indicating that the heater temperature is too high as a cause of the abnormality, to the PC 19, and displays the information to the PC 19 so as to lower the heater temperature.

On the other hand, when the sound is detected ahead at the microphone 35*e*, the cutting failure is generated ahead, and the jam is generated later. Hence, in step S160, the cause of the abnormality is determined that the sharpness of the cutter 33 is deteriorated. Furthermore, the determination corresponds to the case of determining that the cause of the abnormality is a cause H of the abnormality in Table. Therefore, the control unit 20 proceeds to step S170, and outputs the information indicating that the sharpness of the cutter 33 is deteriorated as a cause of the abnormality, to the PC 19, and displays the information to the PC 19 so as to exchange the cutter 33.

According to the method for estimating a cause of an abnormality of the embodiment, it is possible to remove the cause of the abnormality of the recording apparatus 1.

Moreover, in addition to the method for estimating a cause of an abnormality of the embodiment described above, for example, in the case of the detection of the abnormal sound at the microphones 35*b* and 35*c*, and an emergency stop of the carriage 8, when the abnormal sound is detected ahead at the microphone 35*b*, a sliding failure of the guide shaft 11 and the carriage 8 may be determined as a cause of the emergency stop of the carriage 8 (cause I of the abnormality in Table). When the abnormal sound is detected ahead at the microphone 35*c*, the abnormality of the carriage motor 28 may be determined as a cause of the emergency stop of the carriage 8 (cause J of the abnormality in Table).

In other words, the method for estimating a cause of an abnormality of the recording apparatus 1 according to the embodiment, is a method for estimating a cause of an abnormality of the recording apparatus 1 including the microphones which are arranged on the plurality of spots, and estimates the cause of the abnormality from the sound pickup time difference between the sounds which are picked up by each of the microphones.

Hence, it is possible to estimate the generation cause of the abnormality from the sound pickup time difference between the sounds such as the sound pickup order and the sound pickup timing in each microphone. Therefore, it is possible to estimate the cause of the abnormality from the sound pickup time difference, and it is possible to remove the cause of the abnormality.

Figure 5A:
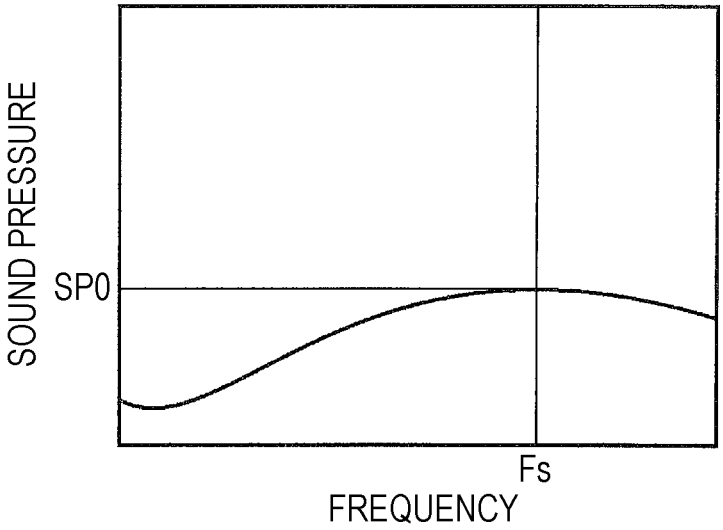
FIGS. 5A and 5B are graphs illustrating a concept of an example of a sound pickup result of the recording apparatus according to the embodiment of the invention.

Here, in the recording apparatus 1 of the embodiment, the case of determining (detection of the abnormal sound) whether or not the sounds which are picked up by the microphones 35*a* to 35*e* are the abnormal sounds, will be described in detail, using FIG. 5A and FIG. 5B which are graphs illustrating a concept of an example of the sound pickup results of the microphones 35*a* to 35*e*. FIG. 5A is a graph illustrating the concept of sound pressure with respect to each frequency (at the normal time) immediately after a use start of the recording apparatus 1, and FIG. 5B is a graph illustrating the concept of the sound pressure with respect to each frequency after the recording apparatus 1 is used for a predetermined time.

Figure 5B:
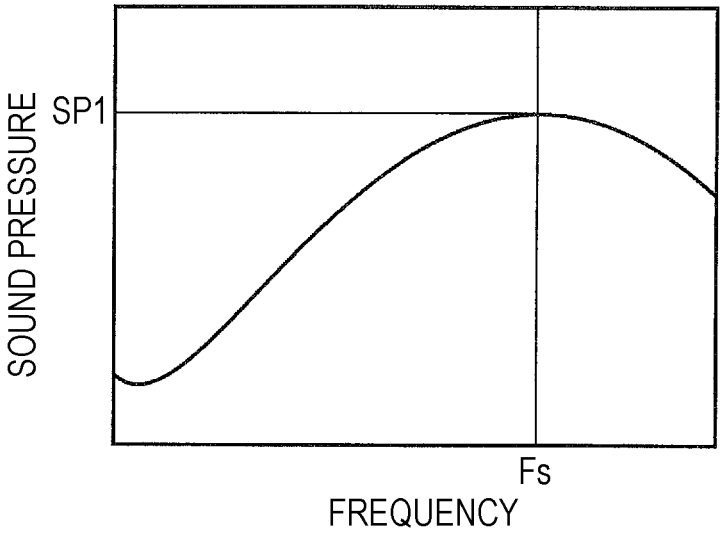

If FIG. 5A is compared with FIG. 5B, a peak value of the sound pressure becomes large from SP0 to SP1, at a predetermined frequency Fs.

Thereupon, in the recording apparatus 1 of the embodiment, the control unit 20 determines whether or not the abnormal sound is generated by a value of the sound pressure at the predetermined frequency Fs.

However, the determination method is not limited thereto, and for example, a method of determining that the abnormal sound is generated when the sound pressure of a predetermined value or more is detected, in a whole detection frequency region of the microphones 35*a* to 35*e*, may be used as a determination method.

As described above, in the recording apparatus 1 of the embodiment, the microphones 35*a* and 35*b* are arranged in the carriage 8 that includes the recording head 9 and moves reciprocatably in the direction B intersecting with the transport direction A of the recording medium P. Moreover, the microphone 35*c* is arranged in the drive unit 37 of the carriage 8. Still more, the microphone 35*e* is arranged in the cutter 33 which is the cutting unit of the recording medium P. Therefore, the microphone 35*d* is arranged in the adjustment unit 12 which is capable of adjusting the gap between the recording head 9 and the recording medium P.

Hence, when the abnormalities which are generated in the recording apparatus 1, range over the plurality of spots, it is possible to determine whether the abnormality on any one spot of the carriage 8, the drive unit 37, the cutter 33 and the adjustment unit 12, is generated ahead or later, and thus, the control unit 20 can estimate the cause of the abnormality.

Furthermore, the recording apparatus 1 of the embodiment, is configured to arrange the sound pickup units in the carriage 8, the drive unit 37, the cutter 33 and the adjustment unit 12. However, if the sound pickup units are configured to be arranged on the plurality of spots, at least one of the sound pickup units may be arranged on any one spot thereof, and the sound pickup units may be arranged in other configuration members.

Moreover, as described above, in the recording apparatus 1 of the embodiment, the microphones 35*a* to 35*e* are arranged in the placement illustrated in FIG. 2. Among these, the microphones 35*a*, 35*b* and 35*e* are arranged in the configuration member which is capable of moving within the recording apparatus 1. However, the microphones 35*a*, 35*b* and 35*e* may be configured to be arranged by fixing the microphones on the inside of the recording apparatus 1.

In such the case, it is preferable that the microphones 35*a* to 35*e* of the embodiment are placed so as to arrange the other microphone on the spot to deviate from a straight line linking the spots on which two microphones of the microphones 35*a* to 35*e* are arranged. In other words, it is preferable that a first sound pickup unit, a second sound pickup unit and a third sound pickup unit are included as a sound pickup unit, and the third sound pickup unit is arranged on the spot to deviate from the straight line that is configured by the spot on which the first sound pickup unit is arranged and the spot on which the second sound pickup unit is arranged.

In such the case, since the cause of the abnormality can be estimated with high accuracy, the control unit 20 can estimate the cause of the abnormality, on the basis of the two-dimensional information instead of the one-dimensional information.

Furthermore, it is preferable that the microphones 35*a* to 35*e* of the embodiment are placed so as to arrange the other microphone on the spot to deviate from a plane linking the spots on which three microphones of the microphones 35*a* to 35*e* are arranged. In other word, it is preferable that a fourth sound pickup unit is further included as a sound pickup unit, and the fourth sound pickup unit is arranged on the spot to deviate from the plane that is configured by the spot on which the first sound pickup unit is arranged, the spot on which the second sound pickup unit is arranged, and the spot on which the third sound pickup unit is arranged.

In such the case, since the cause of the abnormality can be estimated with high accuracy in particular, the control unit 20 can estimate the cause of the abnormality, on the basis of the three-dimensional information instead of the one-dimensional information and the two-dimensional information.

In detail, a merit which is obtained by estimating the cause of the abnormality on the basis of the two-dimensional information, furthermore, the three-dimensional information, is exemplified that an influence of residual noise other than specific noise can be grasped, by changing the position of a sound source. Moreover, the merit is exemplified that the frequency band of which detection sensitivity is good can be used in each microphone, by changing a frequency band. Still more, the merit is exemplified that it can be measured by the frequency band of which an error is small due to the influence of a reflected wave which is not absorbed, using distance attenuation properties.

Additionally, for example, the microphone which picks up the sound in the guide shaft 11, is arranged in the distant position, with respect to the microphone 35*b* that is arranged in the position which is opposed to the guide shaft 11, and the residual noise is removed from the sound which is picked up by the microphone and the sound which is picked up by the microphone 35*b*, and thereby, it is possible to improve detection accuracy. Moreover, even when the frequency band is in a state of being difficult to pick up the sound in sensitivity at the time of the error generation among the sounds in the guide shaft 11, it is possible to detect the error by the microphone which is arranged in the distant position.

Therefore, in a three-dimensional sound field, degrees of freedom in design of the recording apparatus 1 is increased, and a grasp level of the residual noise is enhanced, in comparison with a two-dimensional sound field.

If being described from a different viewpoint, in consideration of the case that each microphone picks up the sound at the same time, in the case of two microphones, it is possible to grasp that the sound source is present somewhere on a center plane which is perpendicular to a line going through the two microphones. In the case of three microphones, a presence range of the sound source is narrowed to be somewhere on a center line which is perpendicular to the plane where the three microphones are present. In the case of four microphones, it is possible to define that the sound source is at the center of a sphere on which the four microphones are ridden. That is, there is the merit that the position where the sound source may be present can be narrowed as the dimension rises. However, there is the case that the spot of the abnormality is unlikely to be specified only from the position information of the sound source, such as the case of two microphones, but the spot of the abnormality can be specified, by combining frequency properties, or the layout information relating to the position where a component having a possibility of generating the abnormal sound is present.

As described above, all of the microphones 35*a* to 35*e* of the embodiment, are the unidirectional sound pickup units. Hence, the unidirectional microphones 35*a* to 35*e* are unlikely to be affected by the noise, in comparison with an omnidirectional (nondirectional) sound pickup unit, and the control unit 20 can estimate the cause of the abnormality with high accuracy.

Moreover, the control unit 20 of the embodiment also serves as an output unit which outputs the estimated cause of the abnormality. Hence, by outputting and notifying the cause of the abnormality to the PC 19 which is an external apparatus, it is possible to grasp the cause of the abnormality to the user.

Here, at the time of the emergency stop of the recording apparatus 1, the control unit 20 can output the cause of the abnormality as the comparative information between the sounds that are picked up by the microphones 35*a* to 35*e* which are arranged on the plurality of spots, and each microphone at the time of picking up the sound.

Hence, at the time of the emergency stop of the recording apparatus 1, it is possible to grasp the cause of the abnormality to the user.

Furthermore, the invention is not limited to the embodiments, and can be variously modified within the scope of the invention which is described in the scope of the claims. Needless to say, the modifications are also included within the scope of the invention.

In the embodiment, the configuration of estimating the cause of the abnormality depending on a detection order in two microphones among the abnormal sounds which are picked up by the microphones 35*a* to 35*e*, is described. However, since the distance from the two microphones can be estimated depending on not only the detection order but also a detection time difference, it is possible to narrow the spot of the component where the abnormal sound is generated. In particular, since the spot where the abnormal sound is generated can be specified from the detection time difference between the abnormal sounds in the microphones of four or more, it is possible to enhance degrees of accuracy in the estimated cause of the abnormality.

Hitherto, the invention is described on the basis of the specific embodiments. Here, the invention will be collectively described again.

The recording apparatus 1 according a first aspect of the invention, includes the sound pickup units 35*a* to 35*e* that are arranged on the plurality of spots, and the output unit 20 that is capable of outputting the comparative information between the sounds which are picked up by the sound pickup units 35*a* to 35*e*, and each sound pickup unit at the time of picking up the sound.

According to the first aspect, the sound pickup units 35*a* to 35*e* that are arranged on the plurality of spots, and the output unit 20 that is capable of outputting the comparative information between the sounds which are picked up by the sound pickup units 35*a* to 35*e*, and each sound pickup unit at the time of picking up the sound, are included. Hence, the comparative information can be notified to the user, and it is possible to estimate the cause of the abnormality, regarding the abnormality which is generated in the recording apparatus 1.

Here, the term of "comparative information between the sound which is picked up by the sound pickup unit, and each sound pickup unit at the time of picking up the sound" means the information including the processed data on the basis of the information, in addition to the information of the sound pickup unit itself which picks up the sound, and the time itself at the time of picking up the sound.

Moreover, since it is sufficient if being capable of outputting the comparative information, the term of "being capable of outputting the comparative information" means to also include the configuration of not outputting the comparative information, if being capable of outputting the comparative information.

In the recording apparatus 1 of a second aspect, the estimating unit 20 that estimates the cause of the abnormality from the sound pickup time difference between the sounds which are picked up by each of the sound pickup units 35*a* to 35*e*, is further included, and the comparative information is the cause of the abnormality.

According to the second aspect, the sound pickup units 35*a* to 35*e* are arranged on the plurality of spots. Hence, it is possible to estimate the generation cause of the abnormality from the sound pickup time difference between the sounds such as the sound pickup order and the sound pickup timing in each of the sound pickup units 35*a* to 35*e*. Therefore, it is possible to estimate the cause of the abnormality from the sound pickup time difference by the estimating unit 20, and it is possible to remove the cause of the abnormality.

In the recording apparatus 1 of a third aspect, the sound pickup units 35*a* to 35*e* are arranged on at least one spot of the movement unit 8 that includes the recording head 9 and moves reciprocatably in the direction B intersecting with the transport direction A of the recording medium P, the drive unit 37 of the movement unit 8, the cutting unit 33 of the recording medium P, and the adjustment unit 12 that is capable of adjusting the gap between the recording head 9 and the recording medium P.

According to the third aspect, the sound pickup units 35*a* to 35*e* are arranged on at least one spot of the movement unit 8 that includes the recording head 9 and moves reciprocatably in the direction B intersecting with the transport direction A of the recording medium P, the drive unit 37 of the movement unit 8, the cutting unit 33 of the recording medium P, and the adjustment unit 12 that is capable of adjusting the gap between the recording head 9 and the recording medium P. Hence, when the abnormalities which are generated in the recording apparatus 1, range over the plurality of spots, it is possible to determine whether the abnormality on at least one spot of the movement unit 8, the drive unit 37, the cutting unit 33 and the adjustment unit 12, is generated ahead or later, and thus, the estimating unit 20 can estimate the cause of the abnormality.

In the recording apparatus 1 of a fourth aspect, the first sound pickup unit, the second sound pickup unit, and the third sound pickup unit are included as the sound pickup units 35*a* to 35*e*, and the third sound pickup unit is arranged on the spot to deviate from the straight line that is configured by the spot on which the first sound pickup unit is arranged and the spot on which the second sound pickup unit is arranged.

According to the fourth aspect, the third sound pickup unit is arranged on the spot to deviate from the straight line that is configured by the spot on which the first sound pickup unit is arranged and the spot on which the second sound pickup unit is arranged. Hence, the estimating unit 20 can estimate the cause of the abnormality, on the basis of the two-dimensional information instead of the one-dimensional information. Accordingly, it is possible to estimate the cause of the abnormality with high accuracy.

In the recording apparatus 1 of a fifth aspect, the fourth sound pickup unit is further included as the sound pickup units 35*a* to 35*e*, and the fourth sound pickup unit is arranged on the spot to deviate from the plane that is configured by the spot on which the first sound pickup unit is arranged, the spot on which the second sound pickup unit is arranged, and the spot on which the third sound pickup unit is arranged.

According to the fifth aspect, the fourth sound pickup unit is arranged on the spot to deviate from the plane that is configured by the spot on which the first sound pickup unit is arranged, the spot on which the second sound pickup unit is arranged, and the spot on which the third sound pickup unit is arranged. Hence, the estimating unit 20 can estimate the cause of the abnormality, on the basis of the three-dimensional information instead of the one-dimensional information and the two-dimensional information. Accordingly, it is possible to estimate the cause of the abnormality with high accuracy in particular.

In the recording apparatus 1 of a sixth aspect, the sound pickup units 35*a* to 35*e* are the unidirectional sound pickup units.

According to the sixth aspect, the sound pickup units 35*a* to 35*e* are the unidirectional sound pickup units. Hence, the unidirectional sound pickup units 35*a* to 35*e* are unlikely to be affected by the noise, in comparison with the omnidirectional (nondirectional) sound pickup unit, and it is possible to estimate the cause of the abnormality with high accuracy.

In the recording apparatus 1 of a seventh aspect, the output unit outputs the comparative information in the case of the emergency stop of the recording apparatus 1.

According to the seventh aspect, the output unit outputs the comparative information in the case of the emergency stop of the recording apparatus 1. Hence, in the case of the emergency stop of the recording apparatus 1, it is possible to grasp the cause of the abnormality to the user.

The method for estimating the cause of the abnormality of the recording apparatus 1 according to an eighth aspect of the invention, is a method for estimating the cause of the abnormality of the recording apparatus 1 that includes the sound pickup units which are arranged on the plurality of spots, and includes estimating the cause of the abnormality from the sound pickup time difference between the sounds which are picked up by each of the sound pickup units 35*a* to 35*e*.

According to the eighth aspect, the sound pickup units 35*a* to 35*e* are arranged on the plurality of spots. Hence, it is possible to estimate the generation cause of the abnormality from the sound pickup time difference between the sounds such as the sound pickup order and the sound pickup timing in each of the sound pickup units 35*a* to 35*e*. Therefore, it is possible to estimate the cause of the abnormality from the sound pickup time difference, and it is possible to remove the cause of the abnormality.

The entire disclosure of Japanese Patent Application No. 2014-65424, filed Mar. 27, 2014 is expressly incorporated by reference herein.

What is claimed is:

1. A recording apparatus comprising:

a sound pickup unit comprising a first sound pickup unit, a second sound pickup unit, and a third sound pickup unit that are arranged on a plurality of spots; and an output unit that is capable of outputting comparative information between a sound which is picked up by the first, second, and third pickup units of the sound pickup unit, and a time that the first, second, and third pickup units pick up the sound, wherein the third sound pickup unit is arranged on a spot to deviate from a straight line that is configured by a spot on which the first sound pickup unit is arranged and a spot on which the second sound pickup unit is arranged.

2. The recording apparatus according to claim 1, further comprising:

an estimating unit that estimates a cause of an abnormality from a sound pickup time difference between the sounds which are picked up by each of the sound pickup units, wherein the comparative information is the cause of the abnormality.

3. The recording apparatus according to claim 1, wherein the sound pickup unit is arranged on at least one spot of a movement unit that includes a recording head and moves reciprocatably in a direction intersecting with a transport direction of a recording medium, a drive unit of the movement unit, a cutting unit of the recording medium, and an adjustment unit that is capable of adjusting a gap between the recording head and the recording medium.

4. The recording apparatus according to claim 1, wherein the sound pickup unit further comprises a fourth sound pickup unit, and the fourth sound pickup unit is arranged on a spot to deviate from a plane that is configured by a spot on which the first sound pickup unit is arranged, a spot on which the second sound pickup unit is arranged, and a spot on which the third sound pickup unit is arranged.

5. The recording apparatus according to claim 1, wherein the sound pickup unit is a unidirectional sound pickup unit.

6. The recording apparatus according to claim 1, wherein the output unit outputs the comparative information in a case of an emergency stop of the recording apparatus.

7. A method for estimating a cause of an abnormality of a recording apparatus that includes a sound pickup unit comprising a first sound pickup unit, a second sound pickup unit, and a third sound pickup unit that are arranged on a plurality of spots, wherein the third sound pickup unit is arranged on a spot to deviate from a straight line that is configured by a spot on which the first sound pickup unit is arranged and a spot on which the second sound pickup unit is arranged, the method comprising:

estimating a cause of an abnormality from a sound pickup time difference between sounds which are picked up by each of the sound pickup units.

* * * * *